US005871407A

United States Patent [19]

Tseng

[11] Patent Number: 5,871,407

[45] Date of Patent: Feb. 16, 1999

[54] CLUB HEAD FOR A GOLF PUTTER

[76] Inventor: Huan-Chiang Tseng, P.O. Box 82-144, Taipei, Taiwan

[21] Appl. No.: 777,094

[22] Filed: Dec. 30, 1996

[51] Int. Cl.[6] ..... A63B 53/04

[52] U.S. Cl. ..... 473/328; 473/338; 473/339; 473/341

[58] Field of Search ..... 473/313, 334, 473/335, 336, 337, 338, 339, 340, 341, 328, 344, 349; D21/217

[56] References Cited

U.S. PATENT DOCUMENTS

| | | | |
|---|---|---|---|
| 3,068,011 | 12/1962 | Sano | 473/328 |
| 3,143,349 | 8/1964 | MacIntyre | 473/338 |
| 3,374,027 | 3/1968 | Jacobs | 473/286 |
| 3,632,112 | 1/1972 | Jacobs | 473/286 |
| 3,841,639 | 10/1974 | Werner | 473/286 |
| 4,361,329 | 11/1982 | Brock | 473/286 |
| 4,580,784 | 4/1986 | Brill | 473/286 |
| 5,464,215 | 11/1995 | Koehler | 473/341 |
| 5,489,097 | 2/1996 | Simmons | 473/336 |
| 5,630,765 | 5/1997 | Moore | 473/340 |

*Primary Examiner*—Sebastiano Passaniti
*Attorney, Agent, or Firm*—A & J

[57] ABSTRACT

A club head for a golf putter including a body portion having a top and a bottom, characterized in that the bottom has a horizontal surface at a central portion thereof, two first inclined surfaces extending upwardly from two sides of the horizontal surface, two second inclined surfaces extending upwardly from the two first inclined surfaces to the top, a third inclined surface extending upwardly from the horizontal surface and the first inclined surfaces, two first weights fitted into the body perpendicularly through the first inclined surfaces, and a second weight fitted into the body perpendicularly through the third inclined surface, whereby the user may strike the golf ball accurately.

1 Claim, 2 Drawing Sheets

CLUB HEAD FOR A GOLF PUTTER

BACKGROUND OF THE INVENTION

1. Field of the Invention

This invention relates to a club head for a golf putter and in particular to one which can improve the striking stability and accuracy.

2. Description of the Prior Art

Referring to FIG. 1, the conventional club head 10 for a golf putter has a horizontal bottom 11, a curved toe 12 and a curved heel 13. However, it is very difficult to use such a golf putter to strike a golf ball to go along a path as desired, especially in uneven grass field.

Therefore, it is an object of the present invention to provide an improved club head for a golf putter which can obviate and mitigate the above-mentioned drawbacks.

SUMMARY OF THE INVENTION

This invention relates to an improved club head for a golf putter.

It is the primary object of the present invention to provide a club head for a golf putter which can improve the stability and accuracy in striking a golf ball.

It is another object of the present invention to provide a club head for a golf putter which can improve the driving characteristics of golf clubs.

It is still another object of the present invention to provide a club head for a golf putter having a center of gravity which is located at a lower and more rear position that of the conventional one.

It is still another object of the present invention to provide a club head for a golf putter which can produce a greater torque than the conventional one.

It is still another object of the present invention to provide a club head for a golf putter which can reduce the resistance of the grass.

It is still another object of the present invention to provide a club head for a golf putter which is simple in construction.

It is a further object of the present invention to provide a club head for a golf putter which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
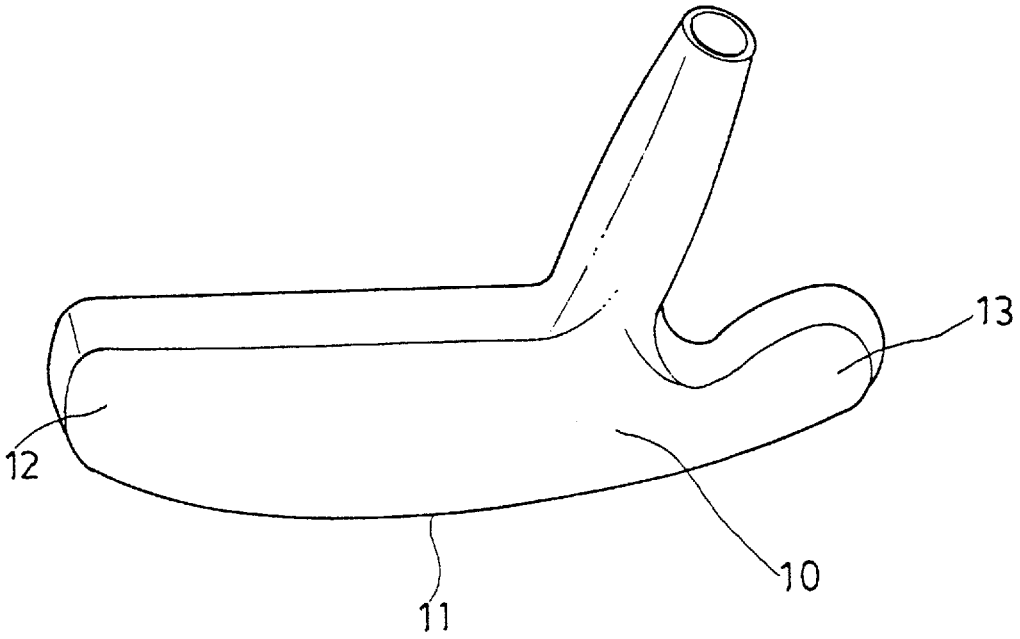
PRIOR ART FIG. 1
FIG. 1 is a perspective view of a prior art club head for a golf putter.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
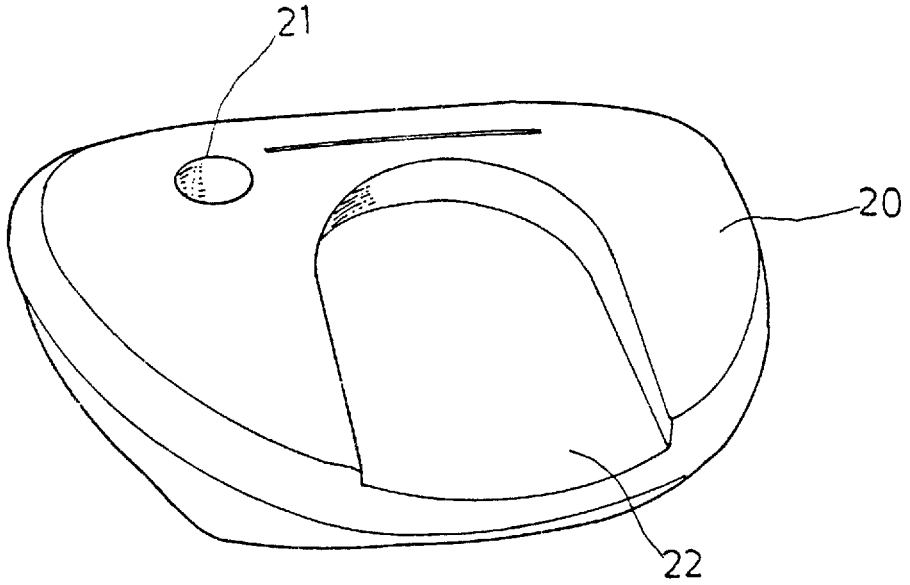
FIG. 2 is a perspective view of a club head for a golf putter according to the present invention.

With reference to the drawings and in particular to FIG. 2 thereof, the club head 20 for a golf putter according to the present invention has a hole 21 close to its left side corner (with respect to FIG. 2) adapted for receiving the lower end of a golf shaft (not shown). The upper side of the club head 20 is formed with a horizontal recess 22. The club head 20 is a generally semi-circular member with the upper portion wider than the lower portion.

Figure 3:
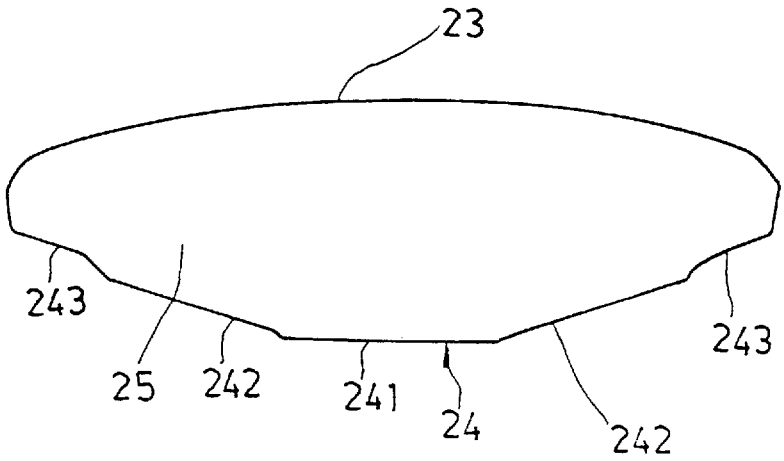
FIG. 3 illustrates the shape of the face of the club head according to the present invention.

FIG. 3 illustrates the shape of the face of the club head 20 according to the present invention. As shown, the face 25 of the club head 20 has a convex top 23 and a five-step sole 24 that makes it look like a bridge, thereby decreasing the influence of the uneven grass field and therefore increasing the striking stability. The bottom five-step sole 24 has a horizontal surface 241 at a central portion thereof, two first inclined surfaces 242 extending upwardly from two sides of the horizontal surface 241, and two second inclined surfaces 243 extending upwardly from the two first inclined surfaces to the top 23. As the sole 24 is of a five-step surface, it will decrease the chance of scraping the grass thereby reducing the resistance of grass.

Figure 4:
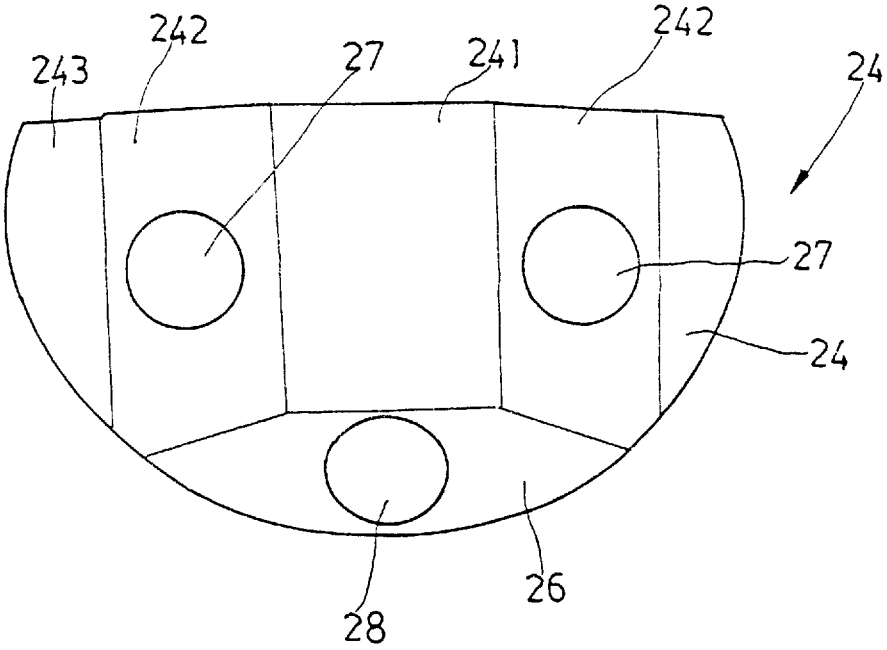
FIG. 4 is a bottom view of the club head according to the present invention.

FIG. 4 is a bottom view of the club head 20 according to the present invention. As illustrated, the club head 20 is formed with a third inclined surface 26 extending from the top 23 to the bottom 24 of the club head 20. A weight 27, perpendicular to each of the inclined sides 242, is fitted in the club head 20. The third inclined, surface 26 is also provided with a cylindrical weight 28 which is fitted in the club head 20 and perpendicular to the third inclined surface 26. The weights 27 and 28 are preferably made of heavy metal such as lead, brass or the like. By means of the three weights 27 and 28, the center of gravity of the club head 20 will be located at a lower and more rear position than the conventional one thus increasing the distance between the hitting point on the ball and the center of gravity and therefore enabling the club head 20 to produce a larger torque than the conventional one. Furthermore, the striking point will not be limited to the geometric center of the face 25 thereby increasing the striking accuracy.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A club head for a golf putter comprising a body portion having a top and a bottom, wherein said bottom has a horizontal surface at a central portion thereof, two first inclined surfaces extending upwardly from two sides of said horizontal surface, two second inclined surfaces extending upwardly from said two first inclined surfaces to said top, a third inclined surface extending upwardly from said horizontal surface and said first inclined surfaces, two first weights fitted into said body perpendicularly through said first inclined surfaces, and a second weight fitted into said body perpendicularly through said third inclined surface.

* * * * *